US008784064B2

(12) United States Patent
Aschenbruck et al.

(10) Patent No.: US 8,784,064 B2
(45) Date of Patent: Jul. 22, 2014

(54) MULTI-COMPONENT BLADED ROTOR FOR A TURBOMACHINE

(75) Inventors: Emil Aschenbruck, Duisburg (DE); Michael Blaswich, Oberhausen (DE); Andreas Kleinefeldt, Ratingen (DE); William F. Cline, Latrobe, PA (US)

(73) Assignee: Man Diesel & Turbo SE, Augsburg (DE)

( * ) Notice: Subject to any disclaimer, the term of this patent is extended or adjusted under 35 U.S.C. 154(b) by 579 days.

(21) Appl. No.: 12/812,862

(22) PCT Filed: Dec. 11, 2008

(86) PCT No.: PCT/EP2008/010557

§ 371 (c)(1),
(2), (4) Date: Jul. 14, 2010

(87) PCT Pub. No.: WO2009/100748

PCT Pub. Date: Aug. 20, 2009

(65) Prior Publication Data

US 2011/0052371 A1 Mar. 3, 2011

(30) Foreign Application Priority Data

Feb. 13, 2008 (DE) ..... 10 2008 008 887

(51) Int. Cl.
*F01D 5/30* (2006.01)

(52) U.S. Cl.
USPC ..... 416/207; 416/214 A

(58) Field of Classification Search
USPC ..... 416/204 R, 207, 208, 214 R, 214 A, 215, 416/218, 204 A
See application file for complete search history.

(56) References Cited

U.S. PATENT DOCUMENTS

| | | | | |
|---|---|---|---|---|
| 1,876,067 | A | 9/1932 | Lorenzen | |
| 2,573,621 | A * | 10/1951 | Sterland | 415/194 |
| 3,689,177 | A * | 9/1972 | Klassen | 416/198 R |
| 3,807,895 | A * | 4/1974 | McMurtry | 415/199.5 |
| 3,976,399 | A * | 8/1976 | Schmoch | 416/201 R |
| 4,021,138 | A * | 5/1977 | Scalzo et al. | 416/95 |
| 4,432,697 | A * | 2/1984 | Miura et al. | 416/198 A |
| 5,741,119 | A * | 4/1998 | Heppenstall | 416/219 R |
| 5,743,713 | A | 4/1998 | Hattori et al. | |
| 7,261,518 | B2 * | 8/2007 | Golinkin et al. | 416/215 |
| 2006/0090447 | A1 * | 5/2006 | Jeske et al. | 60/39.53 |
| 2007/0071608 | A1 * | 3/2007 | Trewiler et al. | 416/241 R |
| 2011/0052371 | A1 | 3/2011 | Aschenbruck et al. | |
| 2012/0201681 | A1 * | 8/2012 | Chauveau et al. | 416/204 A |

FOREIGN PATENT DOCUMENTS

| | | |
|---|---|---|
| DE | 26 43 886 | 2/1978 |

(Continued)

*Primary Examiner* — Edward Look
*Assistant Examiner* — Maxime Adjagbe
(74) *Attorney, Agent, or Firm* — Cozen O'Connor

(57) ABSTRACT

A multipart bladed rotor (1) for a flow machine, particularly a gas turbine or steam turbine or an axial compressor, has at least two disks (2) whose front sides, which face one another, are connected to one another, particularly by positive engagement, in a separating plane (7) so as to be fixed with respect to rotation relative to one another, wherein a groove (10) for receiving a blade root (14) of at least one rotor blade is formed in the separating plane.

14 Claims, 2 Drawing Sheets

(56) References Cited

FOREIGN PATENT DOCUMENTS

| | | |
|---|---|---|
| EP | 1 728 973 | 6/2006 |
| GB | 359 350 | 10/1931 |
| GB | 359350 | 10/1931 |
| GB | 622 626 | 5/1949 |
| GB | 622626 | 5/1949 |
| GB | 710 119 | 6/1954 |
| GB | 710119 | 6/1954 |
| GB | 723 549 | 2/1955 |
| GB | 723549 | 2/1955 |
| JP | 2011-511900 | 4/2011 |

* cited by examiner

MULTI-COMPONENT BLADED ROTOR FOR A TURBOMACHINE

PRIORITY CLAIM

This is a U.S. national stage of application No. PCT/EP2008/010557, filed on Dec. 11, 2008. Priority is claimed on the following application(s): Country: Germany, Application No.: 10 2008 008 887.0, Filed: Feb. 13, 2008, the content of which is/are incorporated here by reference.

FIELD OF THE INVENTION

The invention is directed to a multipart bladed rotor for a flow machine, particularly a gas turbine or steam turbine or an axial compressor, which are connected to one another in a separating plane, and to a flow machine having such rotor.

The invention is directed to a multipart bladed rotor for a flow machine, particularly a gas turbine or steam turbine or an axial compressor, according to the preamble of claim 1, and to a flow machine having a rotor of this kind.

BACKGROUND OF THE INVENTION

Bladed rotors such as those used, for example, as compressor rotors in the compressor area of a gas turbine rotor are often formed of multiple parts comprising individual disks which are connected to one another. Every stage of the compressor can be provided with its own disk or a plurality of rows of blades, each forming a stage, can be arranged on a disk which is known as a multidisk.

Multipart bladed rotors are known, for example, from EP 1 728 973 A1 or DE-OS 26 43 886, in which the individual disks are clamped together axially by tie rods and secured to one another so as to be centered relative to one another and fixed with respect to rotation relative to one another by Hirth serrations which are formed axially between the blade rows.

For mechanical reasons and in order to prevent interruptions in flow, a spur toothing of the kind mentioned above is usually arranged on a diameter which is smaller than the outer diameter of the rotor. In order to produce a radially inner spur toothing of this kind, a free space must be provided to allow sufficient room for the tool to be withdrawn. This disadvantageously increases cost on material, manufacturing and assembly because this free space must be closed with a corresponding filling piece when the rotor is assembled in order to prevent interference of the flow.

FIG. 2 is a partial cross-sectional view through the separating plane 7*a* of a multipart rotor according to the prior art in which a spur toothing 3*a* is arranged on a diameter that is smaller than the outer diameter of the rotor. A free space 10*a* is provided to accommodate the tool movement for producing the spur teeth and must be closed by a filling piece 11.

It is the object of the invention to provide an improved rotor for a flow machine.

SUMMARY OF THE INVENTION

Apart from rotor blades which are constructed integral with the disks, it is also known to detachably fasten rotor blades to the disks in that a blade root of the corresponding rotor blade is secured in radial direction by positive engagement in a correspondingly shaped groove in axial or circumferential direction of the rotor which preferably has one or more undercuts for this purpose. In this connection, FIG. 2 shows a rotor blade 8 whose blade root is inserted into an axial groove and a rotor blade 9 whose blade root is held in a circumferential groove. The blade root can be secured in the groove in an insertion direction by intermediate pieces or closing pieces or by adjoining blade roots which are wedged in or screwed in, for example.

The invention proposes that the separating plane of at least two disks are positioned in a groove of the kind mentioned above which is provided for receiving a blade root of a rotor blade. In this way, a free space required to allow for the withdrawal of the tool is closed by the rotor blade root of the corresponding stage at the same time.

To this end, a multipart bladed rotor, according to the invention, for a flow machine, particularly a gas turbine or steam turbine or an axial compressor, has two or more disks whose front sides, which face one another, are connected to one another in a separating plane so as to be fixed with respect to rotation relative to one another, wherein a groove receiving one or more rotor blade roots is formed in this separating plane.

In this way, production costs and assembly costs for the filling pieces can advantageously be eliminated. At the same time, this can advantageously prevent a weakening of the structure of the rotor, particularly an interruption in the flow of force in the rotor, but also interference in the flow owing to an additional free space in addition to the groove which is required in any case for receiving the blade root. Another advantage can consist in that the manufacture, particularly the cutting manufacture, and monitoring of the groove which is formed so as to be axially divisible by means of, and to the extent of, the separating plane is facilitated.

The two disks can be detachably connected to one another, particularly by positive engagement, so as to be fixed with respect to rotation relative to one another. To this end, in a preferred embodiment of the present invention, a spur toothing, particularly a Hirth-type toothing or a Gleason-type toothing, is formed in the separating plane. The at least two disks can then be connected to one another axially by one or more tie rods. In an alternate construction, the two disks can also be non-detachably connected, e.g., welded, to one another in the separating plane. The two forms can also be combined in that one disk is detachably connected to an adjacent disk, particularly by a spur toothing, and non-detachably connected, particularly welded, to an opposite adjacent disk.

In the present case, the disks are defined particularly as rotationally symmetrical portions of the rotor.

Grooves for blade roots can extend in axial direction of the rotor as is known, e.g., from DE-OS-1 182 474. In this case, it is advantageous when every tooth base of a spur toothing terminates in an axial groove of this kind which accordingly allows for the required tool clearance. However, the groove is preferably a groove extending in circumferential direction of the rotor for receiving a plurality of blade roots which are distributed along the circumference. For this purpose, the groove can have a fir-tree cross section. Within the meaning of the present invention, a fir-tree cross section is characterized in that it has one or more undercuts in radial direction, behind which corresponding projections of the blade root can engage so as to secure the blade root in radial direction by positive engagement.

In a preferred construction, a spur toothing extends radially in a groove base of the groove. This means that the spur toothing is arranged on the radial inner side of the groove formed at the outer circumference on a diameter which is smaller than the outer diameter of the rotor.

The blade roots can advantageously be arranged between the two halves of the groove which are separated by the separating plane before connecting the two disks so that when the disks are joined they engage behind undercuts of the groove which is then closed. In this case, there is no need for an insertion flank in the circumferential groove such as is provided for inserting the blade roots in grooves which are formed in one-piece disks. Therefore, in a preferred construction, the groove can have a cross section which is substantially constant in circumferential direction of the rotor.

The separating plane can be formed axially at any point on the groove. It preferably extends substantially through the centroid of a groove cross section so that the blade root is supported approximately equally in both disks. In particular, the groove can be formed substantially symmetric to the separating plane. By symmetry is meant in the present context not only a mathematical symmetry in which the contour of one disk in an axial section corresponds to the complementary contour of the other disk, but also a functional symmetry, for example, the forming of undercuts which correspond to one another but which can be offset relative to the other disk particularly in radial direction. This is especially advantageous in gas turbine compressor rotors in which the outer radius of the rotor hub generally increases in the direction of flow in order to allow for the increasingly compressed fluid.

One or more additional rows of blades can be provided parallel to the separating plane on one or both disks so that a disk of this kind forms a plurality of stages of the flow machine. Additional rows of blades of the kind mentioned above can also be fastened in a positive engagement by means of blade roots held in additional grooves or can be formed integral with the disk, i.e., by primary shaping, or can be non-detachably connected, e.g., welded or riveted, to the disk. Also, a combination is possible in which one or both disks have blades which are held in grooves and also have blades which are formed integral with the disk.

In a flow machine according to the invention with a multipart bladed rotor, two or more disks can be connected to one another so as to be fixed with respect to rotation relative to one another in a separating plane in which a groove is formed for receiving one or more blade roots.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

Further advantages and features of the present invention are described in connection with the drawings in which:

FIG. 1 shows an axial half-section through the upper half of a gas turbine according to an embodiment of the present invention. A compressor rotor 1 of the gas turbine is constructed as a disk-type rotor, wherein each disk 2, as a so-called multidisk, has a plurality of rows of rotor blades 5 which are distributed along the circumference, these rows being arranged axially one behind the other. The blade roots of the rotor blades 5 are held in corresponding grooves 6 in circumferential direction of the rotor 1. The grooves 6 have assembly openings which make it possible to insert the blades (not shown).

DETAILED DESCRIPTION OF THE PRESENTLY PREFERRED EMBODIMENTS

The disks 2 are positioned relative to one another by means of Hirth-type spur teeth 3 or Gleason-type teeth and are clamped by screws or tie rods 4 to form a rotor composite.

Figure 2:
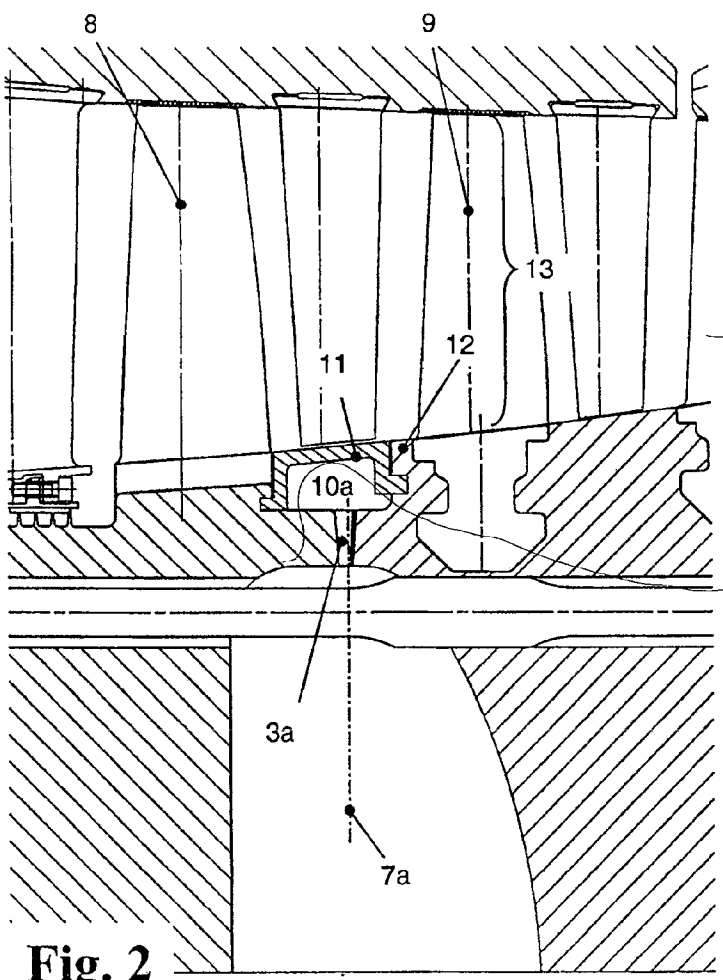
Fig. 2 Prior Art
FIG. 2 is an axial partial sectional view through two rotor blades on disks of a prior-art rotor which are connected to one another in a separating plane.

In a rotor according to the prior art, a section of which is shown in FIG. 2, the separating planes 7*a* of the multidisks are arranged between grooves of two adjacent blade rows 8 and 9. Since the Hirth-type spur toothing 3*a* is arranged on a diameter which is smaller than the outer diameter of the compressor disks, a corresponding free space 10*a* must be provided to allow for the withdrawal of the tool for the process of producing the toothing 3*a*. This free space 10*a* must be closed with corresponding filling pieces 11 when assembling the rotor to ensure a continuous hub contour and, therefore, a continuity of the inner wall 12 of the flow channel 13 of the gas turbine.

Figure 1:
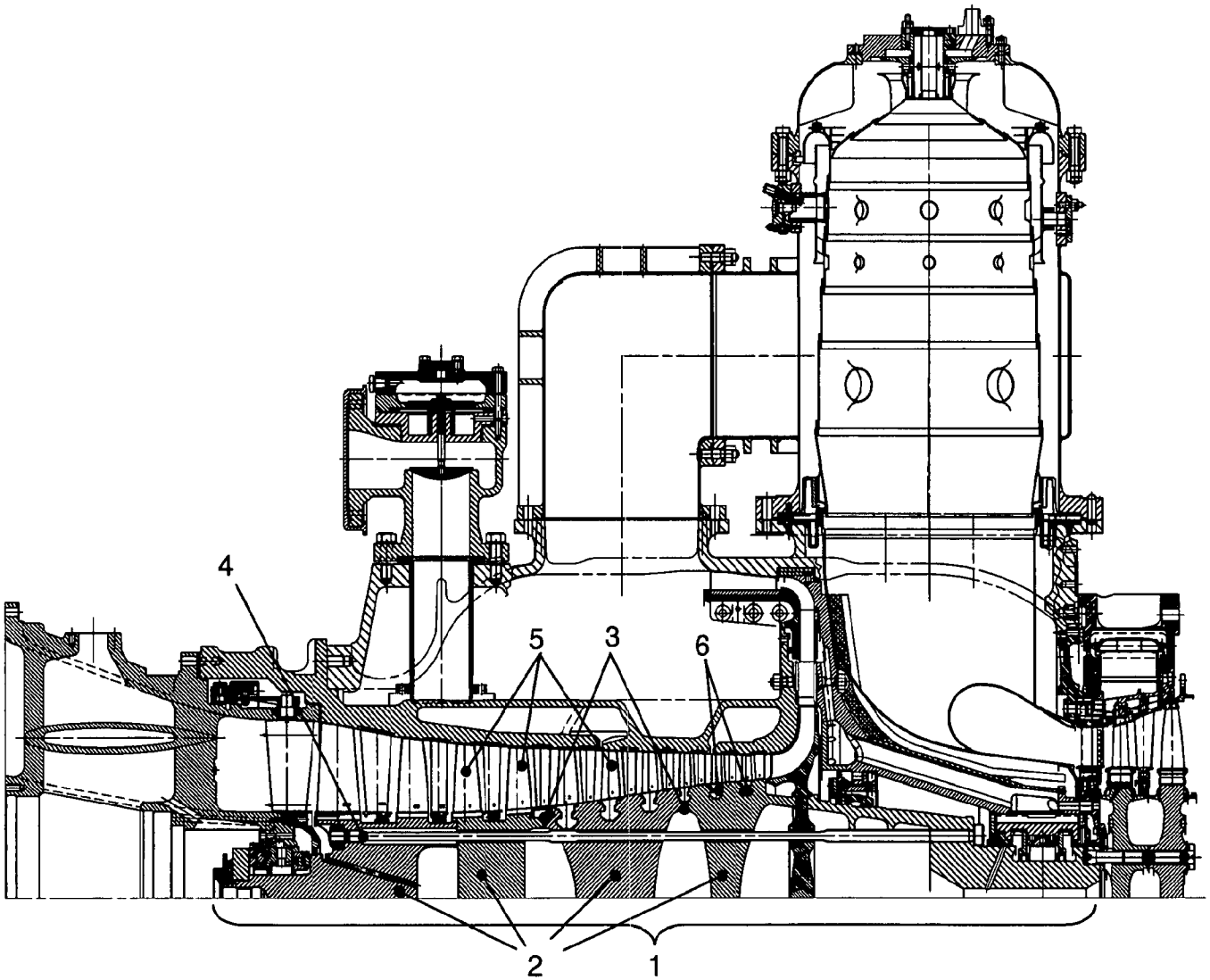
FIG. 1 is an axial half-sectional view through a gas turbine according to an embodiment of the present invention.
Figure 3:
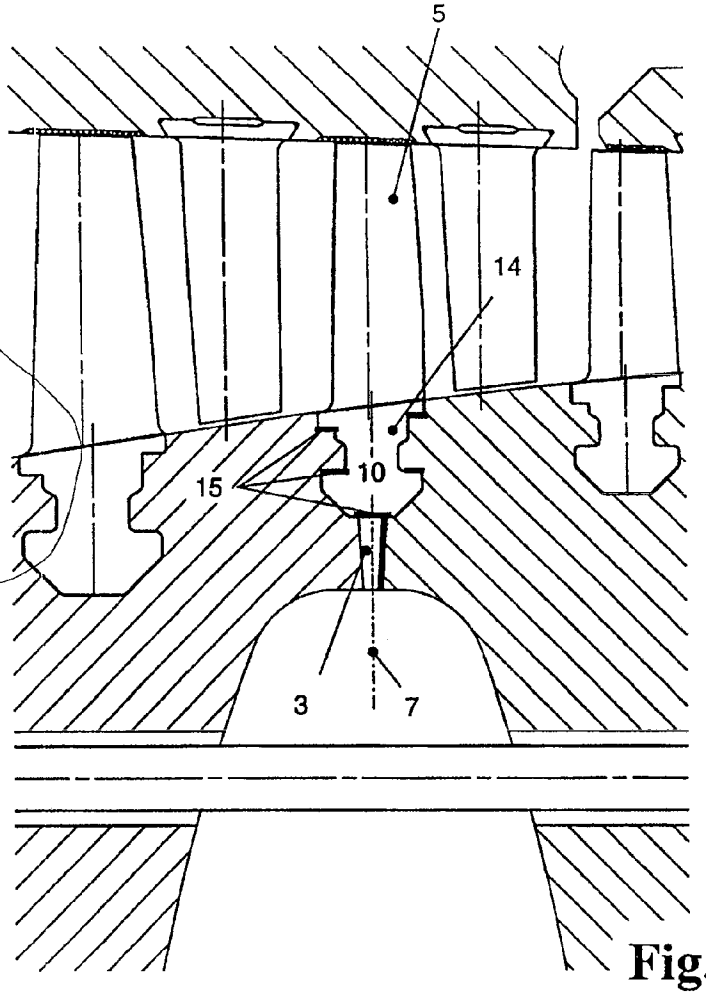
FIG. 3 is a partial view corresponding to the view in FIG. 2 showing two disks of a rotor, according to an embodiment of the invention, which are connected to one another in a separating plane.

In a rotor according to an embodiment of the present invention, shown in FIG. 3, such as can be used, for example, in a gas turbine according to FIG. 1, the separating plane 7 of adjacent multidisks is situated in the plane of symmetry of a groove 10 for receiving blade roots 14 of rotor blades 5. The Hirth-type spur toothing 3 is arranged radially below this groove 10 which is divided axially in this way. This arrangement has the advantage that the groove 10 can be used at the same time as free space to allow for the withdrawal of the tool for producing the Hirth-type spur toothing 3.

The groove 10 is closed by the roots 14 of the compressor rotor blades 5 of the corresponding stage when the rotor is assembled.

This arrangement has the advantage that the additional filling piece 11 can be dispensed with. Further, the manufacture and monitoring of the surfaces 15 in the axially divided groove 10 is facilitated.

The invention is not limited by the embodiments described above which are presented as examples only but can be modified in various ways within the scope of protection defined by the appended patent claims.

In another construction, not shown, the blades of the stages between the separating planes are formed as an integral component part of the disks (bladed disk or BLISK).

LIST OF REFERENCE NUMBERS

1 compressor rotor
2 disk
3, 3*a* Hirth-type spur toothing
4 tie rod
5 rotor blade
6 groove
7, 7*a* separating plane
8, 9 blade row
10 groove
10*a* free space
11 filling piece
12 inner wall
13 flow channel
14 blade root
15 surfaces

The invention claimed is:

1. A multipart bladed rotor (1) for a flow machine, comprising:

at least two individual disks (2) each carrying at least one rotor blade, each of the individual disks having front sides facing one another; and a connector that connects said disks to one another, by clamping, in a separating plane (7) so as to be fixed with respect to rotation relative to one another, said disks defining a groove (10) formed in the separating plane for receiving a blade root (14) of at least one rotor blade.

2. The rotor according to claim 1, wherein said disks are connected to a spur toothing formed in the separating plane.

3. The rotor according to claim 2, wherein said groove comprises a groove base and wherein said spur soothing extends radially in said groove base below said blade root.

4. The rotor according to claim 1, wherein said groove comprises a groove cross-section and a centroid said separating plane extending substantially through said centroid of said groove cross section.

5. The rotor according to claim 4, wherein said groove is formed substantially symmetric to said separating plane.

6. The rotor according to claim 1, wherein said groove has a fir-tree shaped cross section.

7. The rotor according to claim 1, wherein said groove is extending in circumferential direction of the rotor for receiving a plurality of blade roots which are distributed along the circumference.

8. The rotor according to claim 7, wherein said groove has a cross section which is substantially constant in circumferential direction of said rotor.

9. The rotor according to claim 1, comprising at least one additional row of blades on at least one of said two disks parallel to said separating plane.

10. The rotor according to claim 9, additionally comprising a second groove and wherein a second row of blades is fastened in a positive engagement by means of blade roots held in said second groove.

11. The rotor according to claim 1, wherein said connector comprises a tie rod and wherein said at least two disks are connected to one another axially by means of said tie rod.

12. A flow machine having a multipart bladed rotor according to claim 1.

13. The rotor according to claim 2, wherein said spur toothing is one of a Hirth-type toothing and a Gleason-type toothing.

14. The flow machine of claim 12, wherein the flow machine is selected from the group consisting of a gas turbine, a steam turbine and an axial compressor.

* * * * *